US006520390B2

(12) United States Patent
Verdugo et al.

(10) Patent No.: US 6,520,390 B2
(45) Date of Patent: Feb. 18, 2003

(54) TACTICAL SLING SYSTEM

(76) Inventors: Edward Anthony Verdugo, 141 Myrtelwood Dr., Calimesa, CA (US) 90266; Wallace N. Kaiser, 623 W. 49th St., San Bernardino, CA (US) 92407

( * ) Notice: Subject to any disclaimer, the term of this patent is extended or adjusted under 35 U.S.C. 154(b) by 0 days.

(21) Appl. No.: 09/976,741

(22) Filed: Oct. 12, 2001

(65) Prior Publication Data

US 2002/0020725 A1 Feb. 21, 2002

Related U.S. Application Data

(62) Division of application No. 09/418,746, filed on Oct. 15, 1999.

(51) Int. Cl.[7] ..... F41C 23/02

(52) U.S. Cl. ..... 224/150; 24/2.5; 42/85; 224/149; 224/217; 224/258; 224/913

(58) Field of Search ..... 224/150, 149, 224/257, 258, 913, 259; 24/2.5; 42/85

(56) References Cited

U.S. PATENT DOCUMENTS

| | | | | |
|---|---|---|---|---|
| 1,088,314 A | | 2/1914 | Wilke | |
| 1,194,699 A | | 8/1916 | Badger | |
| 4,841,658 A | | 6/1989 | Katsenes | |
| 5,067,267 A | | 11/1991 | Ives | |
| 5,303,859 A | | 4/1994 | Jenkin | |
| 5,642,847 A | * | 7/1997 | DeMeo et al. | 224/149 |
| 5,802,756 A | | 9/1998 | Hightower | |
| 5,810,219 A | | 9/1998 | Rosenfield | |
| 6,260,748 B1 | * | 7/2001 | Lindsey | 224/150 |

FOREIGN PATENT DOCUMENTS

| | | |
|---|---|---|
| WO | WO 8500423 | 1/1985 |

* cited by examiner

*Primary Examiner*—Stephen K. Cronin
*Assistant Examiner*—Maerena W. Brevard
(74) *Attorney, Agent, or Firm*—Curt Harrington

(57) ABSTRACT

An adjustable sling system provides a quick release fitting which enables a sling system to transition from a close to the body quick fire position to an away from the body aiming position. The adjustable sling system incorporates a first end having a first attachment fitting carried closer to the forward grip of a rifle having a first portion of the first end attached to an extended rubber core web surrounded section. A release clip has a first end supported by a tension ring which is supported along a length of webbing extending from the first portion, and includes a riveted connection to the web strap and reinforcement plate as it extends from the first end. The slope in the direction of capture is calculated with respect to the force of the spring action to insure that the close body position is maintained absent a deliberate forward aiming motion. A second adjustable sling system for use with military full back pack or load bearing equipment such as a load bearing vest enables a slide fitting on a rifle sling to be used with a "Y" shaped support which connects to a backpack. Rifle attached fittings are disclosed which permit rifles to be supported in the vertical position with either of the first or second adjustable sling systems.

13 Claims, 8 Drawing Sheets

TACTICAL SLING SYSTEM

This is a division of application Ser. No. 09/418,746 filed Oct. 15, 1999.

BACKGROUND OF THE INVENTION

The present invention relates to a tactical sling system to assist and enable law enforcement and military personnel to better and more efficiently support and usefully manipulate their sling mounted weapons, and more particularly to systems which enable close body carriage in high alert situations and converting to a distanced body carriage to enable a sight aimed position.

Conventional weapons sling systems have several shortcomings which denigrate their complete utilization in tactical situations. The first and most obvious is seen with respect to the vast majority of slings which are used for the two main purposes of carrying a rifle or other long weapon from a shouldered position, and the use of the sling for wrapping partially about the extended arm of the shooter to steady the weapon for sniping or distance aiming. The carriage of the weapon near the body in its upright orientation simply is not easily attainable with most sling systems because the attachment points for a sling on a conventional rifle or other long weapon is from fittings on the bottom of the rear stock and extending from a position at the bottom of the weapon near the front grip.

Further, most sling systems do not enable the rifle to be carried close to the body with a quick adjust to a second carriage position where the rifle may be brought forward for action. Most straps require a fumbling adjustment to go from one position to the other. With these limitations, the weapon may be carried close to the body and only fired on short notice in a lowered position. Alternatively, a strap can be adjusted to an extended position, but the rifle will receive no substantial close body support except by the user supporting it completely by the use of the arms. The fatigue factor from supporting the rifle completely with the arms diminishes the reaction time and accuracy of the user.

Most tactical team members carry, in addition to a rifle, supplies, communication equipment, ammunition, body armor, and other utility equipment. Managing the rifle, in addition to the other equipment, makes the need for a tactical sling system even more acute.

What is needed is a sling system which enables a rifle to be carried in an upright, ready for firing orientation, and provides a quick, virtually instant transition between a close to the body fire-from-a-lowered-position orientation to an extended aiming fire orientation. The needed sling system should be as silent as possible, avoiding self generated sounds as well as making sounds against the rifle or other equipment. The sling system should provide for stable support of the rifle in all of the carry positions and release only by either the natural aiming action, or by a manual release. The needed sling should be adjustable to enable a user to adjust for a variety of both close to the body and away from the body positions. The needed sling should also have the ability to permit backpack carry of the rifle.

SUMMARY OF THE INVENTION

To meet the above described need, an adjustable sling system provides a quick release fitting which enables the sling system to transition from a close to the body quick fire position to an away from the body aiming position. The adjustable sling system incorporates a first end having a first attachment fitting carried closer to the forward grip of a rifle having a first portion of the first end attached to an extended rubber core web surrounded section. A release clip has a first end supported by a tension ring which is supported along a length of webbing extending from the first portion, and includes a riveted connection to the web strap and reinforcement plate as it extends from the first end. The release clip has an overall "U" shape, and where one side of the "U" shape is indented to apply force to the other side to provide one factor in keeping a buckle fitting within the release clip when a rifle is to be carried at the side in quick shoot position. The angular approach to the force contact area is more gently sloped in the direction of entry to facilitate a re-positioning into the close body position. The slope in the direction of capture is calculated with respect to the force of the spring action to insure that the close body position is maintained absent a deliberate forward aiming motion. In addition the buckle fitting includes a first aperture which enables it to slide on the web strap away from the first end, and a second aperture through which the release clip operates and which secures a post on the buckle fitting between the first and second apertures, and within the release clip. The buckle fitting is curved to provide increased holding force when the rifle is carried in the close body position and to provide an easier release force when the rifle is raised to the aiming position.

The web strap extends away from the first end, through a shoulder adjust fitting, then through a strap aperture of the buckle and then to a termination at the shoulder adjust fitting at a second end. The second end typically terminated in a loop about the shoulder adjust fitting. A sliding fitting preferably includes a tension ring which slides along the web strap nearer the first end of the an adjustable sling system and provides a second attachment fitting to attach to the rifle nearer its stock end. Permissible terminations for both the first and second attachment fittings may include hooks, snap hooks, or buckle and web adjustable attachment fittings.

A second adjustable sling system for use with military full back packs is disclosed and which enables a sliding fitting on a rifle sling to be used with a "Y" shaped support which connects to a backpack or load bearing equipment. This second adjustable sling system enables a soldier to off load some of the effort in supporting his rifle on the sling system while enabling a wide range of support orientations of the rifle to be achieved. The rifle may be left to rest in a general vertical, downwardly oriented position to free the soldier's arms when the rifle is not being utilized.

Rifle attached fittings are disclosed which permit rifles to be supported in the vertical position with either of the first or second adjustable sling systems.

BRIEF DESCRIPTION OF THE DRAWINGS

Objects and features of the invention will become apparent from a reading of a detailed description in conjunction with the drawing, in which.

DETAILED DESCRIPTION

Figure 1:
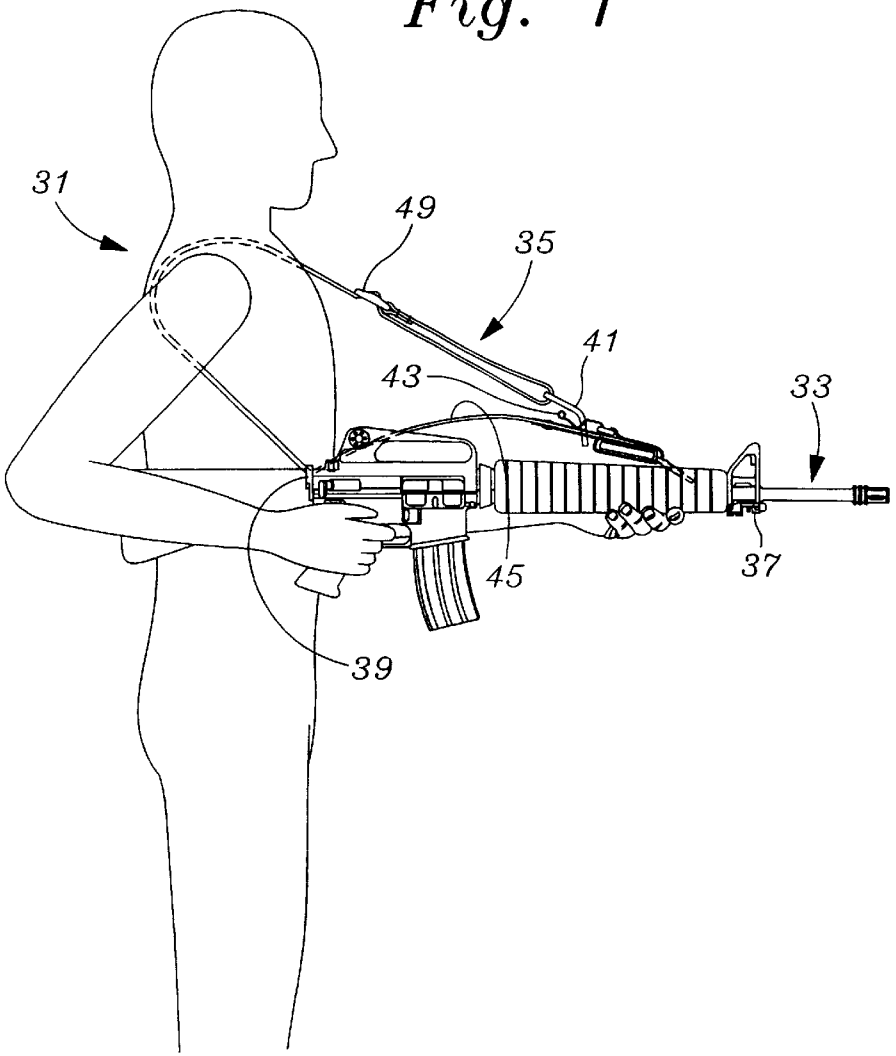
FIG. 1 is a side view of a user wearing a first embodiment of the sling system of the invention extending between a front rifle attachment point to a rear rifle attachment point, underneath the right arm, across the back and top of the left shoulder and back to a first fitting near the front rifle attachment point, the first embodiment of the sling system being carried in a close to the body position.

A detailed description of the embodiments of the invention are best begun with reference to FIG. 1. A wearer 31 carries a rifle 33 utilizing a first embodiment of the sling system 35. The system 35 is utilizable with any relatively longer weapon such as a rifle, shotgun, machine gun, carbine, or other weapon. The description is made with respect to a rifle, but the rifle embodies all of the aforementioned weapons and more. The sling system 35 is attached near the forward end of rifle 33 at a bayonet fitting 37 and at point near the stock of the rifle 33 by a ring fitting 39. The fittings 37 and 39 were chosen for this particular rifle, the M-16, due to the availability of structure supporting the fittings 37 and 39 and it is understood that other rifles will have other structures for supporting different types of fittings which may be utilizable with the sling system 35 of the invention. Generally, the only objective of such other fittings is that they permit the rifle to be carried in a generally upright position as seen in FIG. 1.

The sling system 35 is seen extending from a point near the ring fitting 39 up along the right side of the wearer 31, across the wearer's back and left shoulder, and thence across the wearer 31's chest to terminate at a curved buckle 41 engaged by a clip 43. The buckle 41, when not engaged by clip 43 is set to slide freely along a length of web strap 45 extending between the ring fitting 39 and the bayonet fitting 37.

Note the curvature of the buckle 41 and the close body position of the rifle 33 and in which the rifle is carried in a relatively forward position. As the rifle 33 is brought farther down, the buckle fitting 41 achieves a more angled position against a fitting adjacent the length of web strap 45 extending between the ring fitting 39 and the bayonet fitting 37. In this position, the buckle fitting 41 is almost locked in place and will not leave the clip 43. If the rifle 33 is brought more forward, the buckle fitting 41 will assume an orientation more nearly parallel to the length of web strap 45, and the disengagement of the buckle fitting 41 will be in an optimum position to be disengaged from the clip 43 upon application of a tension force from the user's left shoulder pulling rearward on the buckle fitting 41.

An adjustment fitting 49 is provided to enable a loosening or tightening of the sling system 35 regardless of whether the sling system 35 is carried in a position close to the body or in a position to permit firing. The adjustment fitting 49 is preferably a three parallel post fitting having a pair of adjacent openings. but wherein the termination of the strap of the sling system 35 loops around one outside post and where the slidable length of strap enters one opening, extends over a middle post and exits downwardly through the second opening and underneath the termination about the adjacent outside post. The action which results is the ability to lengthen the sling system 35 by simply pulling downwardly on the strap which is outermost with respect to the user 31. Tightening the general fit of the sling system 35 involves a manual lifting of the adjustment fitting 49 while pulling down on the strap which is innermost with respect to the user 31.

Figure 2:
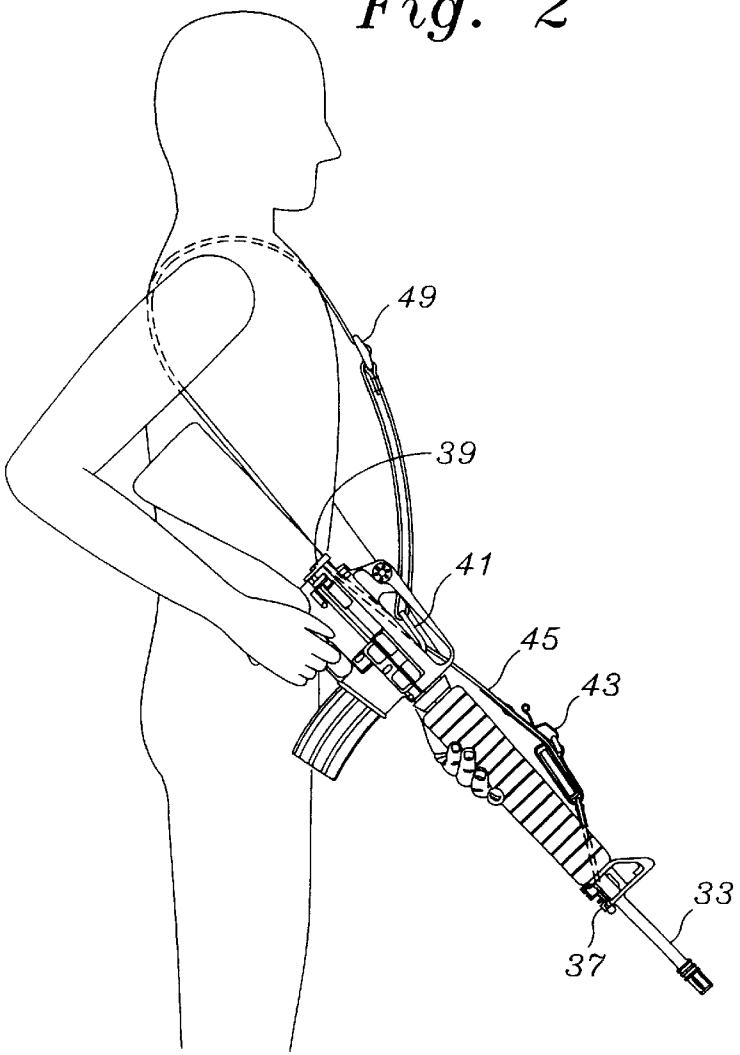
FIG. 2 is a view similar to that of FIG. 1, but where the first embodiment of the sling system has released to a second position for aiming and then lowered for carrying in order to illustrate the position of the sliding release buckle.

Referring to FIG. 2, a position of the sling system 35 in which the buckle fitting 41 is released from the clip 43 has enabled the buckle fitting 41 to slide rearwardly toward the ring fitting 39. In this condition, the buckle fitting 41 can move rearwardly to the ring fitting 39. However, the ring fitting 39 is also slidably connected to the length of web strap 45. Although the rearward movement of the buckle fitting 41 is limited by a second fitting (not yet seen) near the ring fitting 39, the length of web strap 45 can continue to move through both the second fitting (not yet seen) and the buckle fitting 41 to enable a further freeing of the rifle 33 at the expense of a tightening of the portion of the sling system 35 extending around the wearer.

Figure 3:
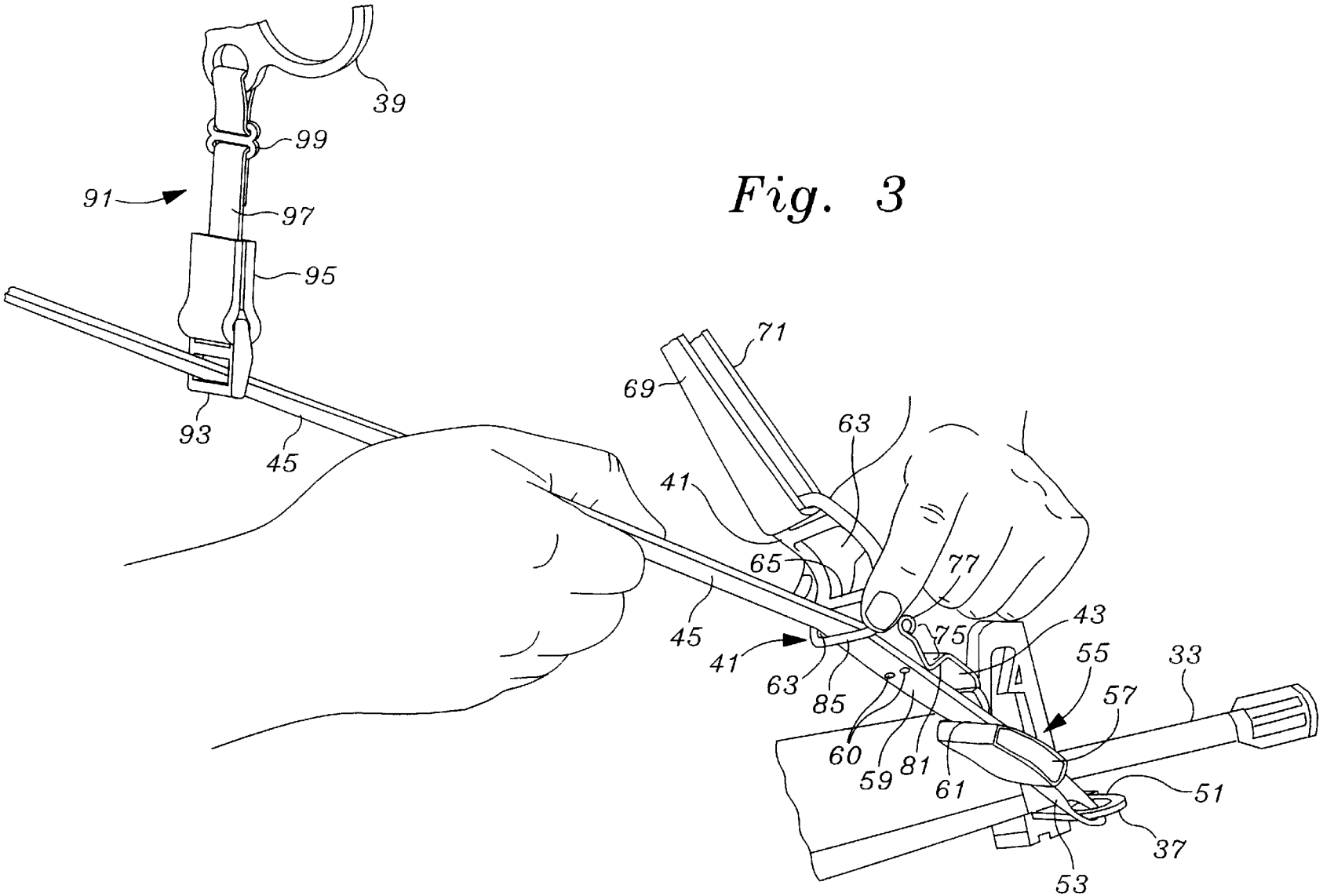
FIG. 3 is a view of the sling system along a length of web strap lying next to the rifle and illustrating manual actuation of the curved buckle fitting and slide fitting assembly.

Referring to FIG. 3, a closeup of the buckle fitting 41 and retaining clip 43 is seen. Beginning with the rifle 33, a bayonet fitting 37 includes a ring structure 51 onto which a snap fitting 53 is engaged. The snap fitting 53 is attached to a hugging strap (not shown) which is closely sewn to a folded and sewn first end 55 of the sling system 35. The strap material at the first end 55 is folded around a block of rubber 57 to provide stiffness and noise silencing. In addition, a stiff length of thin material 59 is partially secured by rivets 60, and is also partially inserted into a fold 61 formed by the strap material as it surroundably encloses the block of rubber 57. The combination of the thickness of the strapping extending away from the block of rubber 57 toward the main extent of the sling system 35 and the stiff length of thin material 59 is thin enough to accommodate an opening 63 of the curved buckle fitting 41. A second opening 63 is a main opening and accommodates the clip 43 passing through the opening 63, and over a post 65. An upper opening 67 is engaged by a looping strap of the sling system 35 and includes an innermost strap section 69 and an outermost strap section 71, taken with respect to the body of the user of FIG. 1.

The retaining clip 43 includes a gently angled portion 75 terminating in a cylindrically curled end 77, as well as a main internal space 79 bounded by a more abruptly angled portion 81. The more abruptly angled portion 81 assists in retaining the post 65 once captured within the retaining clip 43, while the gently angled portion 75 assists in manually capturing the post 65 within the retaining clip 43. FIG. 3 shows the wearer 31 manually re-setting the curved buckle fitting 41 to be held within the retaining clip 43.

Note the curvature of the curved buckle fitting 41. In a high angle position with respect to the captured length of web strap 45 and stiff length of thin material 59, an outer edge post 85 and post 65 have an angular relationship which is somewhat restrictive of movement of the buckle fitting 41 along the length of web strap 45. This restrictive pinching, combined with the fact that the pulling force is perpendicular with respect to the length of web strap 45 and stiff length of thin material 59, gives the sling system 35 high holding force for the rifle 33 in the close to body position. As the curved buckle fitting 41 begins to recline with respect to the length of web strap 45 and stiff length of thin material 59, the opening 63 begins to loosen about this combination of materials and becomes more freely slidable. In addition, when the innermost and outermost strap sections 69 and 71 cause the curved buckle fitting 41 to recline and to exert a force on the curved buckle fitting 41 more parallel to the length of web strap 45 and stiff length of thin material 59, a force begins to bear directly upon the abruptly angled portion 81. This force causes the release of the curved buckle fitting 41 from the retaining clip 43. Because the outer edge post 85 always bears on the combination of the length of web strap 45 and stiff length of thin material 59, the force from the curved buckle fitting 41 never upwardly bears on the upper member of the retaining clip 43 to cause it to open from such perpendicular force. As a result, the retaining clip 43 is always protected from strap forces, will never become bent open due to strap forces, and will operate against the length of web strap 45 and stiff length of thin material 59 time after time with only the lateral pushing force of the post 65, in a direction generally parallel to the length of web strap 45 and stiff length of thin material 59, as the operating force.

The length of web strap 45 surrounding the block of rubber 57 helps to limit the movement of the snap fitting 53 about a pivotal axis parallel to the end of rubber block 57 and thus helps to suppress undue rattling at the end of the sling system 35 at the forward end of the rifle 33. As will be seen, the innermost strap section 69 and outermost strap section 71 looping through the curved buckle fitting 41 provide a mechanical advantage to the adjustment fitting 49 of FIG. 1 and half the pulling force on the adjustment fitting 49 resulting from any downward pressure on the curved buckle fitting 41. This enables the adjustment fitting 41 to be less loosely engaged by the innermost strap section 69 and enables the adjustment fitting 41 to be more easily manipulated by the wearer 31.

Further back along the length of web strap 45 is a second rifle fitting as a slide fitting assembly 91. Slide fitting assembly 91 includes a slide ring 93 secured by a short sewn stiffened length of strapping 95 formed into a folded "Double U" shape and capturing a length of adjustment webbing 97 in its middle. Adjustment webbing 97 extends through a buckle 99, around the ring fitting 39 and then back through the buckle 99. The slide fitting assembly 91 beyond the slide ring 93 represents an alternative example of attachment structure which can be used to attach to structure depending from a rifle. A snap fitting 53 could be used in conjunction with slide fitting assembly 91, and the adjustment webbing 97 and buckle 99 could be used in conjunction with the folded and sewn first end 55 of the sling system 35. Other attachment structure can also be used.

Figure 4:
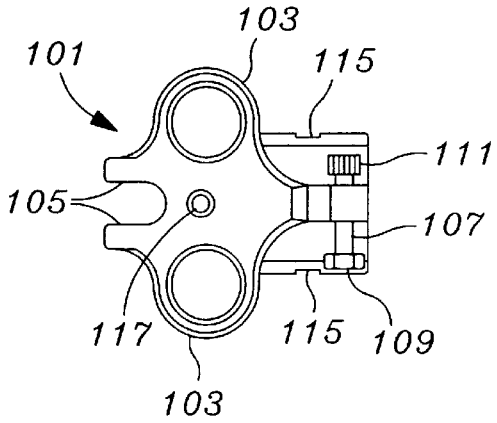
FIG. 4 is a top plan view of a bayonet fitting used to attach to a rifle to facilitate attachment of the sling system embodiments of the present invention.

Referring to FIG. 4, a plan closeup view of a two sided version of the one sided version of the bayonet fitting 37 seen in FIGS. 1, 2, & 3 is seen as a fitting 101. Instead of a single ring structure 51, a set of double, left and right side ring structures 103 are seen. The view of FIG. 4 is a top view, looking down onto the surface which would face the underside of the rifle. A front fork fitting 105 is used to hold the front portion of the fitting 101 in place, while a bolt 107 and lock nut 109 extends through the rear section of the fitting 101 to hold it in place once the front fork fitting 105 is in place. Bolt 107 preferably has a hexagonal drive head 111.

A lower base plate 113 is for supporting another structure at the bottom of the fitting 101. The ends 115 of a downwardly directed slot mounting space, which can be used for mounting lasers, lights, and other objects, is seen. It is understood that the fitting 101 accommodates both left handed and right handed wearers 31 but that single ring structures 51 on one sided bayonet fittings 37 can be used. Also seen is the tip end of a pressure set screw 117 which is meant to bear against a bottom surface of the rifle 33. Since the front fork fitting 105 has an angular mounting process, there will be some tolerance between the fitting 101 and the rifle 33. Insertion of the bolt 107 at the rear of the bayonet fitting 101 locks it into place, but there may be enough tolerance left for a slight rattle. In addition, where the bayonet fitting is used to support laser sights, etc, the bayonet fitting 101 cannot tolerate either a rattling noise nor any significant instability. The set screw 117 is turned until it rises upwardly and against the rifle 33, which urges the bayonet fitting 101 downward into a rigid locked configuration.

Figure 5:
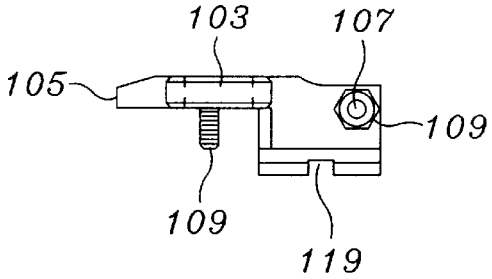
FIG. 5 is a side view of the bayonet fitting of FIG. 4.
Figure 6:
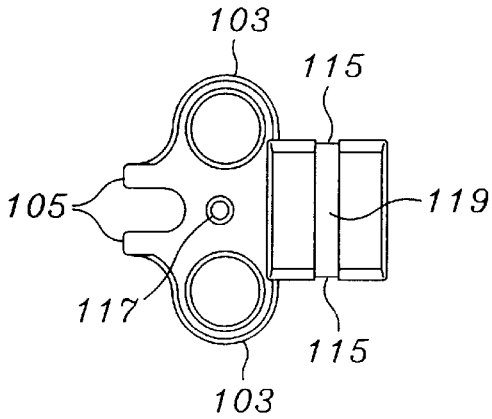
FIG. 6 is a bottom view of the bayonet fitting of FIGS. 4 and 5.

Referring to FIG. 5, the slot 119 can be seen as extending across the fitting 101. The set screw 117 can be seen in a downward orientation before being threadably turned upward to bear against the rifle 33. Referring to FIG. 6, a bottom view of the bayonet fitting 101 seen in FIGS. 4 & 5 give a better visual illustration of the components thereof.

Figure 7:
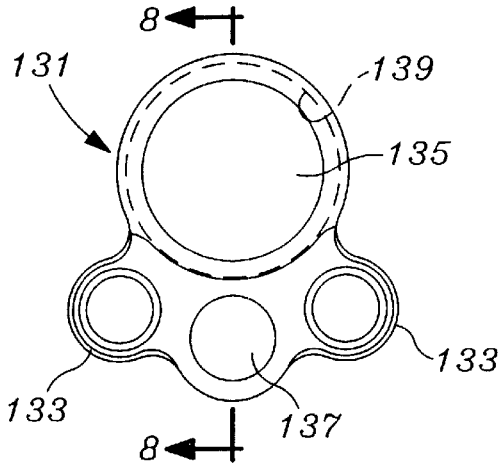
FIG. 7 is a rear end view of a ring fitting utilizable with an M-16 rifle to facilitate attachment of the sling system embodiments of the present invention.

Referring to FIG. 7, a plan view of a two ring, left and right hand ring fitting 131 is seen which is similar to the ring fitting 39 seen in FIGS. 1–3. The fitting rings 131 and 39 provide at least one attachment ring 133 which is configured to protrude from the side of the rifle 33 at a high point relative to the stock of the rifle 33 to enable rifle 33 to be suspended in its normal firing orientation. The use of two attachment rings 133 as seen in FIG. 7 enables a rifle to be supported from either of the right hand or left hand side.

The fitting 131 has a main aperture 135 which fits over a receiver extension tube support for a stock of a rifle 33 such as an M-16 .223 caliber rifle. The axial thickness of the attachment ring 133 will cause a rifle stock to be displaced rearward by that thickness, which is only about ⅜ of an inch. The opposite faces of the fitting 131 should match the surfaces with which they interfit. FIG. 7 is a view looking forward onto the fitting 131 and facing the rear surface thereof. A rounded depression interfits with a projection on the stock. The main aperture 135 contains a grooved transition to a greater diameter opening 139 to accommodate the configuration of the rear of the rifle 33 receiver. The smaller diameter is seen surrounding the main aperture 135.

Figure 8:
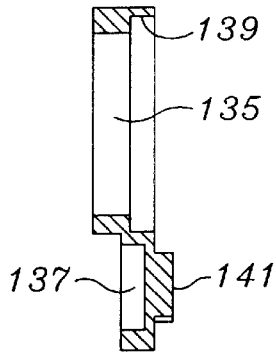
FIG. 8 is a side view of the bayonet fitting of FIG. 7.
Figure 9:
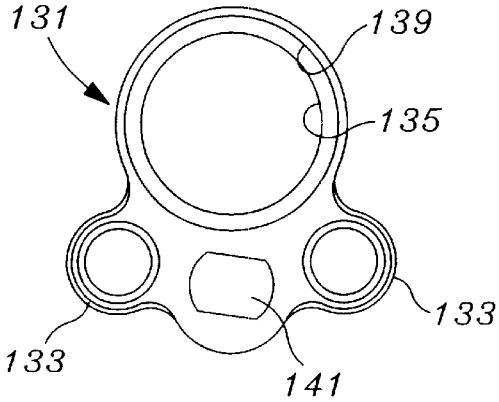
FIG. 9 is a bottom view of the bayonet fitting of FIGS. 7 and 8.

Referring to FIG. 8 a side view illustrates the depression 137 which is opposite a projection 141 which fits into an accommodating opening in the rear of the receiver of the rifle 33. Both the projection 141 and the depression 137 are used to register the fitting 131 so that it will not rotate about its main aperture 135. Referring to FIG. 9, a view of the side of fitting 131 opposite to that shown in FIG. 7 is seen.

Figure 10:
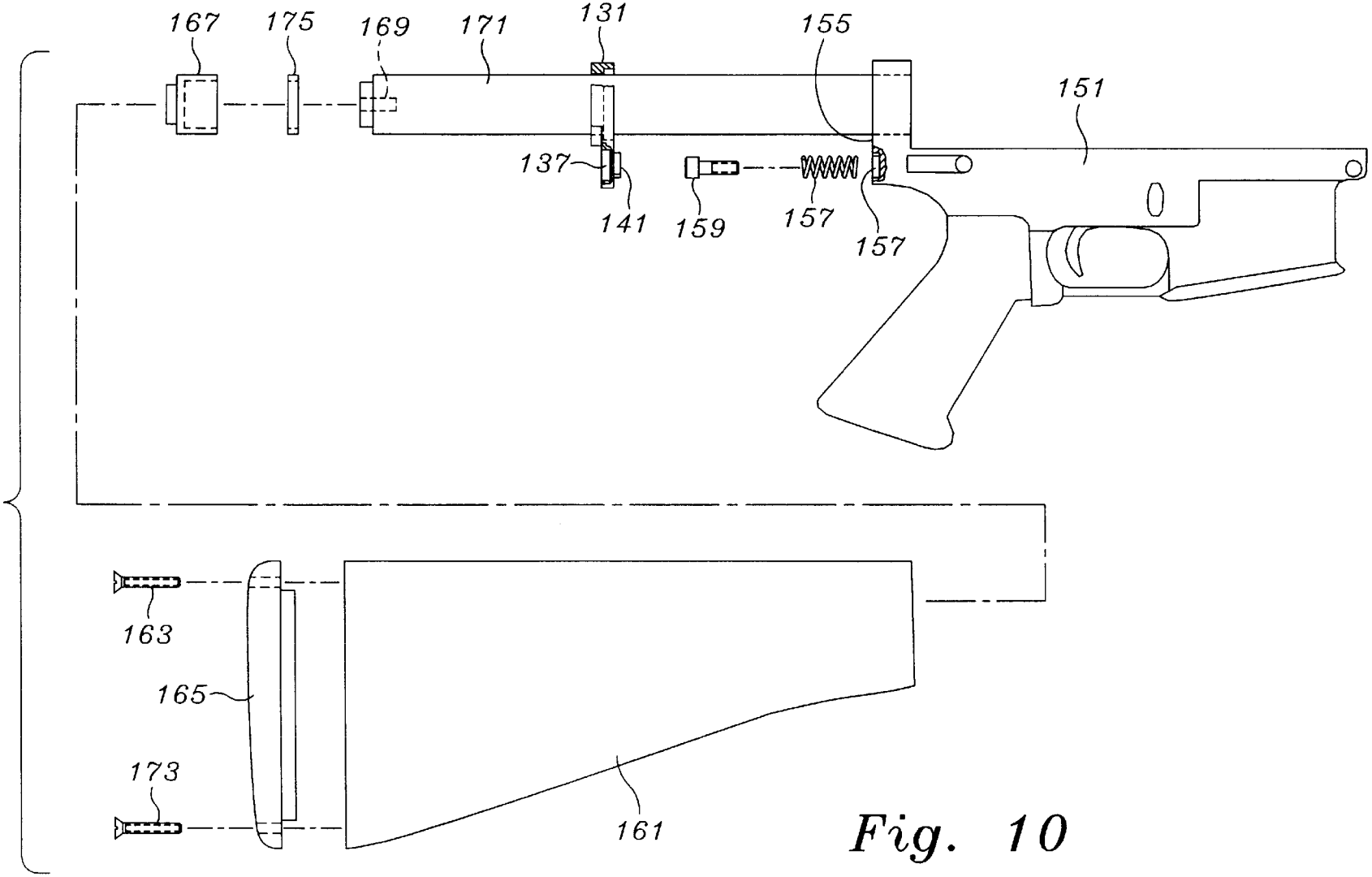
FIG. 10 is an exploded view of an M-16 rifle and illustrating the method and order of attachment of a ring fitting, compensating spacer and compensating longer butt plate screw to accommodate the axial dimension of the ring fitting.

Referring to FIG. 10, an illustration of the installation of the fitting 131 is seen. A rifle 33 receiver 151 has a rear surface 153 having a depression 155. Beyond the depression 155 is a bore supporting a spring 157 to urge a pin 159 outward from the bore supporting the spring 157. The spring 157 and pin 159 normally urge a stock 161 rearwardly during breakdown to assist in removal and to keep the rifle 33 "tight". A pair of butt plate screws including an upper screw 163 attach a butt plate 165 to stock 161 and a spacer 167 to a threaded bore 169 in a receiver extension tube 171. A lower butt plate screw 173 attaches the lower end of the butt plate 165 to the stock 161.

When the fitting 131 is added, the stock 161 rides just slightly farther back on the receiver extension tube 171. The upper butt plate screw 163 provided as original equipment is likely not to be able to reach the threaded bore 169. A new longer upper butt plate screw 163 is provided along with a spacer 175 to compensate for the slight rearward displacement of the stock 161 while providing force distribution for the spacer 167 against internal structures in the stock and rear structures of the receiver extension tube 171.

Figure 11:
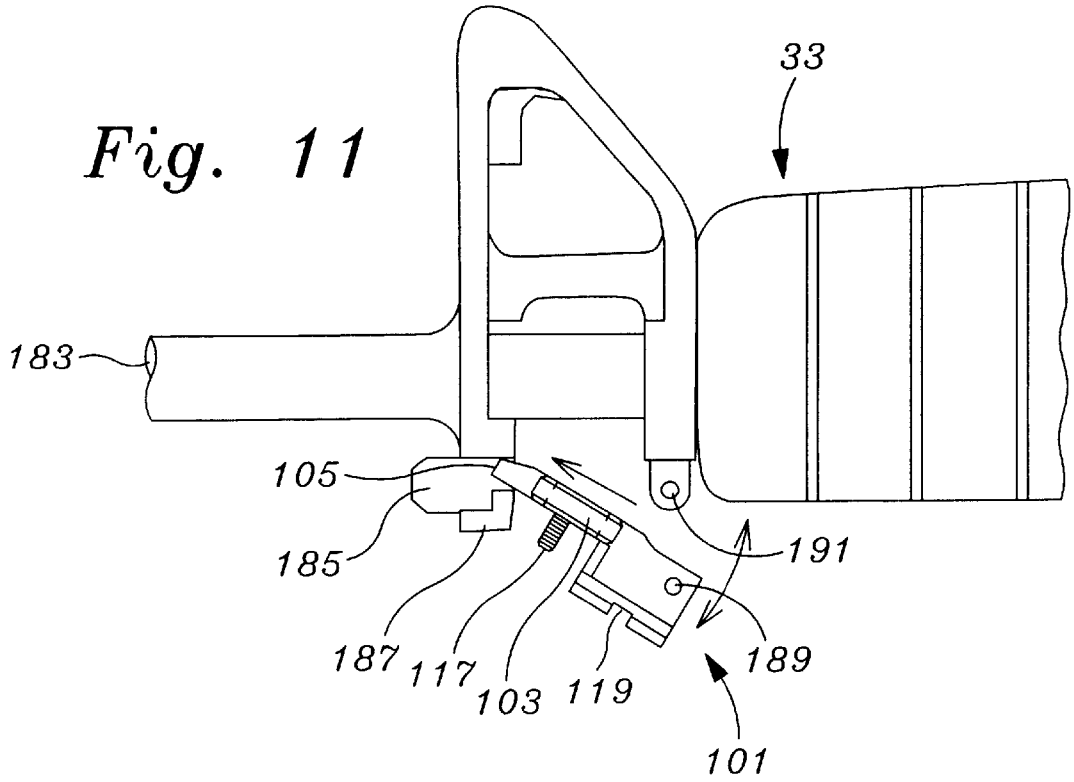
FIG. 11 is a side view of a front bayonet fitting area of an M-16 rifle and illustrating the method of attachment of the bayonet fitting into a position underneath the barrel.
Figure 12:
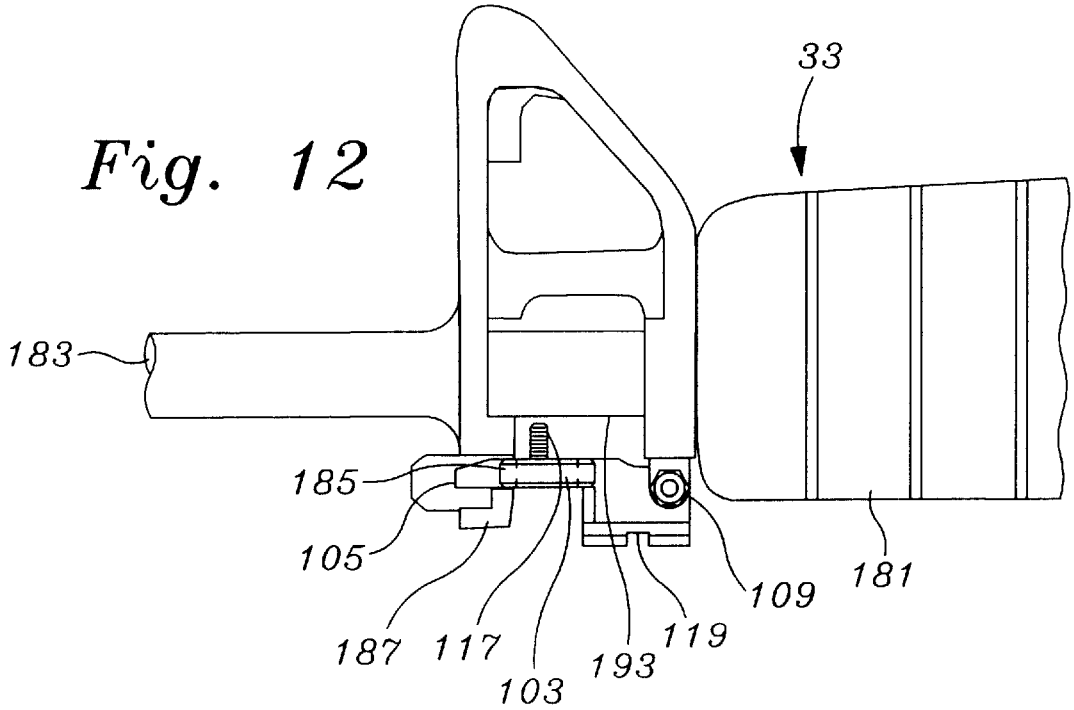
FIG. 12 is a side view as seen in FIG. 12 but with bolt and lock nut in place and with pressure set screw adjusted to apply force upward against a surface of the barrel to stabilize the bayonet fitting.

Referring to FIGS. 11 and 12, installation of the bayonet fitting 101 is illustrated on a rifle 33 having a front grip 181. Just below the barrel 183, a split structure 185 contains a pair of side members 187, only one of which is seen in the side view of FIG. 11. The front fork fittings 105 of the bayonet fitting 101 are brought upward and forward at an angle to rest upon the side members 187. The bolt 107 has been removed from a bore 189 of the bayonet fitting so that the bore 189 could be brought into alignment with a pair of apertures of which one aperture 191 is seen on the rifle 33. Once the apertures 191 are aligned with the bore 189, the bolt 107 is inserted therethrough and the lock nut 109 is added to the bolt 107. This is seen in FIG. 12. Next, the set screw 117 is rotated until it bears on a surface 193 below the barrel 183 to force the front fork fitting 105 down into a stable configuration.

Figure 15:
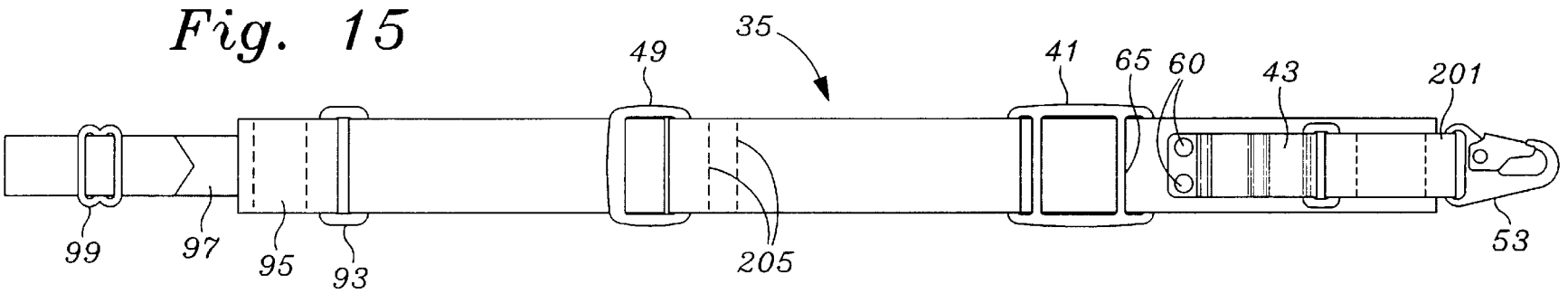
FIG. 15 is a plan view of the first embodiment of the sling set of the invention corresponding to the orientation of FIG. 14 and illustrating the curved buckle fitting as released from within the retaining clip.
Figure 14:
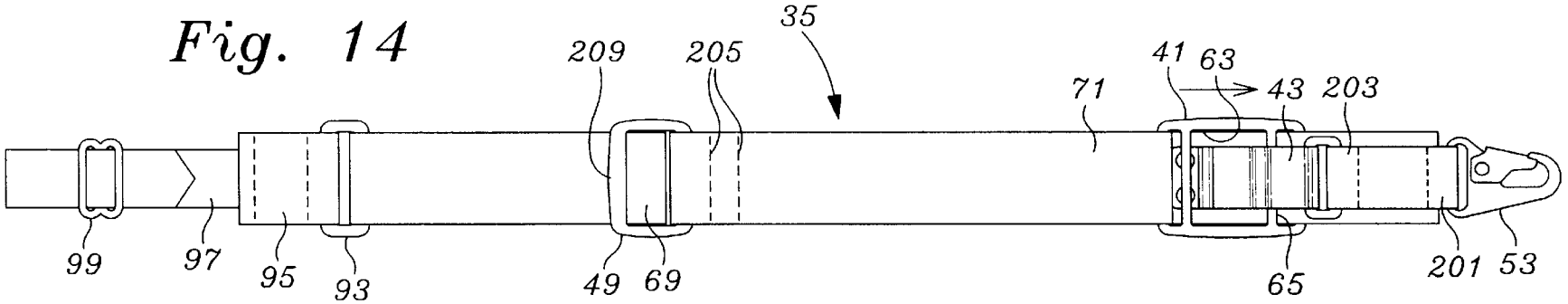
FIG. 14 is a plan view of the first embodiment of the sling set of the invention corresponding to the orientation of FIG. 13 and illustrating the curved buckle fitting captured within the retaining clip.
Figure 13:
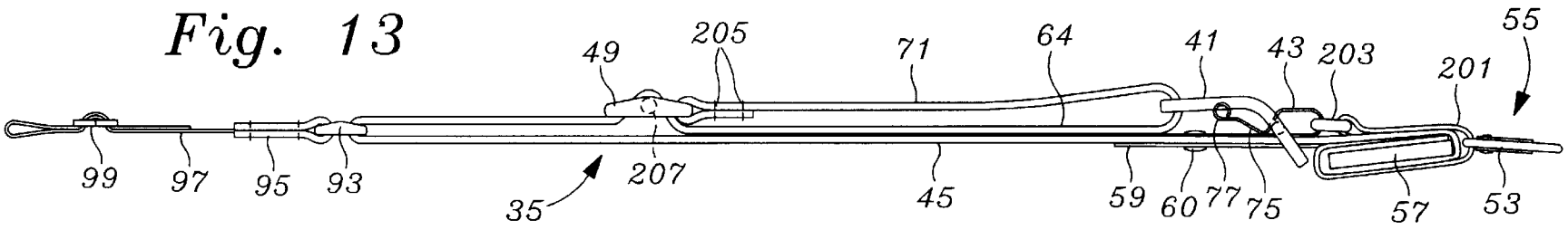
FIG. 13 is a side view of the first embodiment of the sling set of the invention and illustrating the details and extent of the strapping, connectors, buckles and rings.

Referring to FIG. 13, further details of the sling system 35 are seen. Beginning at the first end 35, an outer closely sewn loop of material 201 is seen to engage the snap fitting 53, and a rectangular connector ring 203. Connector ring 203 engages the retainer clip 43 in its main internal space 79 and provides a force anchor opposing the pulling of the curved buckle fitting 41 from the retaining clip 43. The space between the innermost strap section 69 and the length of web strap 45 is generally where the wearer 31's shoulder is located. Stitching 205 is seen joining the end of outermost strap section 71 around an end post of the adjustment fitting 49. The innermost strap section 69 is seen extending through one opening of the adjustment fitting 49, over a middle post 207 and back underneath a second side post 209. Stitching 211 is seen on the sewn stiffened length of strapping 95. FIG. 14 shows a plan view of the sling system 35 seen in FIG. 13, with the curved buckle fitting 41 engaged by the retaining clip 43. FIG. 15 shows a plan view of the sling system 35 seen in FIG. 14, with the curved buckle fitting 41 disengaged from the retaining clip 43.

Figure 16:
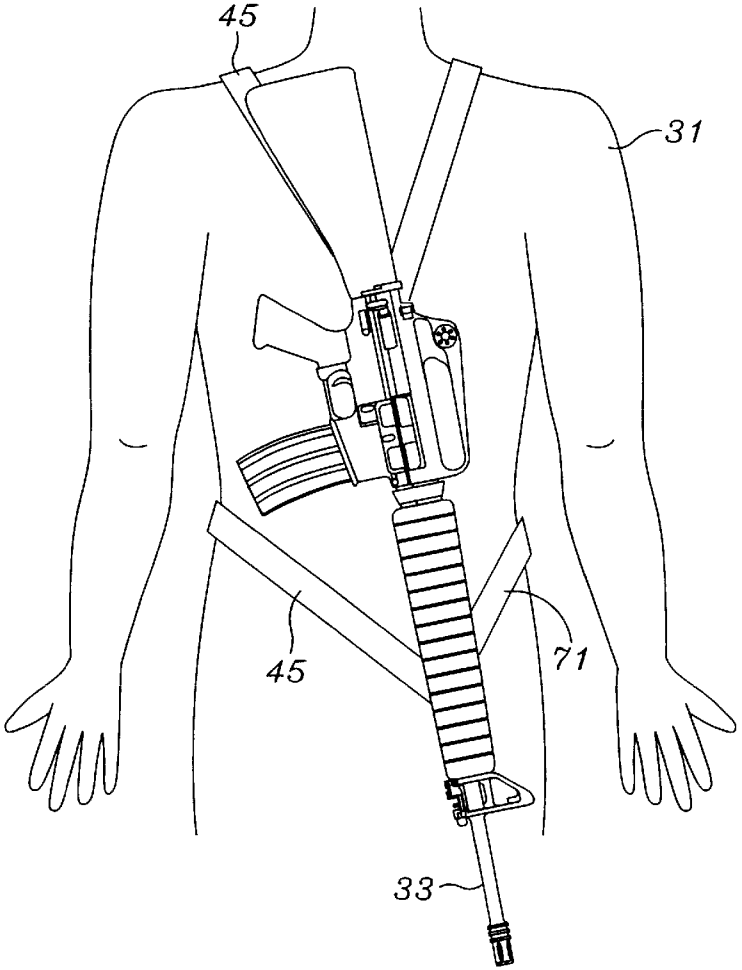
FIG. 16 is a view of the first embodiment of the sling system worn by a user in a back pack or load bearing equipment configuration.

Referring to FIG. 16, the sling system 35 is seen in a backpack configuration achievable by loosening the adjustment fitting 49 and bringing it closer to the curved buckle fitting 41 and splitting the length of the strap about the slide ring 93 to two approximately equal lengths between slide ring 93 and first end 55 at the curved buckle fitting 41 and the snap fitting 53. When utilizing bayonet fitting 101 and ring fitting 131, the sling system 35 becomes both a right and a left hand system. All that is needed is reversal of the main sling system 35 over the right shoulder, and re-attachment of the snap fitting 53 and the slid fitting assembly 91 to the rifle 33.

Figure 17:
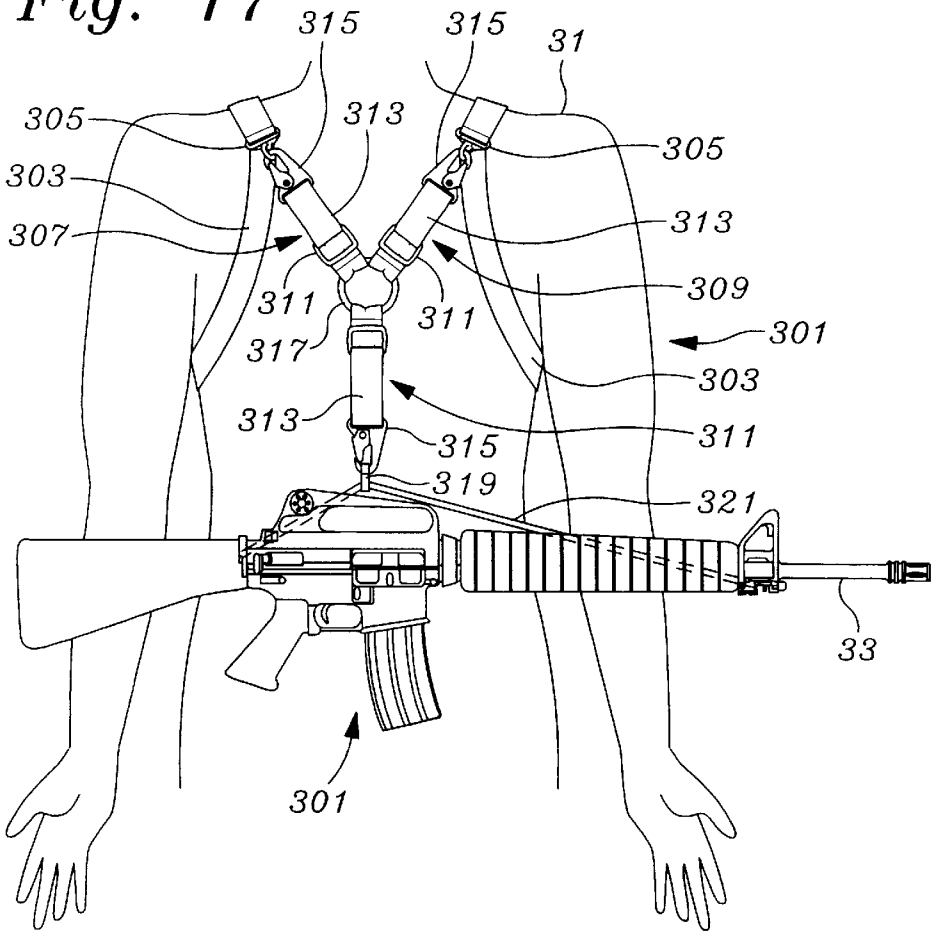
FIG. 17 is a view of a second embodiment of the sling system of the invention and shown with respect to a wearer also wearing a back pack or load bearing equipment and where the sling system is supported by existing back pack or load bearing equipment straps at the front of a wearer.

Referring to FIG. 17 a second embodiment of a sling system 301 is seen in combination with a backpack, of which back pack or load bearing equipment shoulder straps 303 are seen at the front of the FIG. 17. The backpack straps 303 may be fitted with connector rings 305 which are generally supported along the back pack or load bearing equipment straps 303 to resist downward movement. The connector rings 305 are preferably each integral with a loop suitable for a chest center connector set having three strap sets numbered 307, 309 and 311. Each of the strap sets 307, 309 and 311 includes a length of strapping 313 and a quick connector 315. Each of the strap sets 307, 309 and 311 is attached to a central ring 317. The strap sets 307 & 309 can be adjusted to center the central ring 317 for the comfort of the user.

The quick connector 315 of the strap set 311 is connected to a connector ring 319 which includes a separate ring portion for connection to the quick connector 315 and a ring portion for slidable attachment to a sling strap 321 which is again shown as connected to the rifle 33, by way of the rifle's bayonet fittings 37, 101 and ring fittings 39, 131 which are the same as was illustrated in the earlier Figures. Since the sling strap 321 has an extent with only some extra length between its points of attachment to the rifle 33, there is an easy movement of the rifle 33 both forwardly and rearwardly with the sling strap 321 freely moveable through the connector ring 319. In this configuration, the wearer 31 can turn the rifle 33 to a close to the body position, lift the rifle 33 to aiming position, or assume a number of other positions with the arms and hands. Where the arms and hands are needed for other tasks, the rifle 33 can simply be left suspended as seen in FIG. 17.

Figure 18:
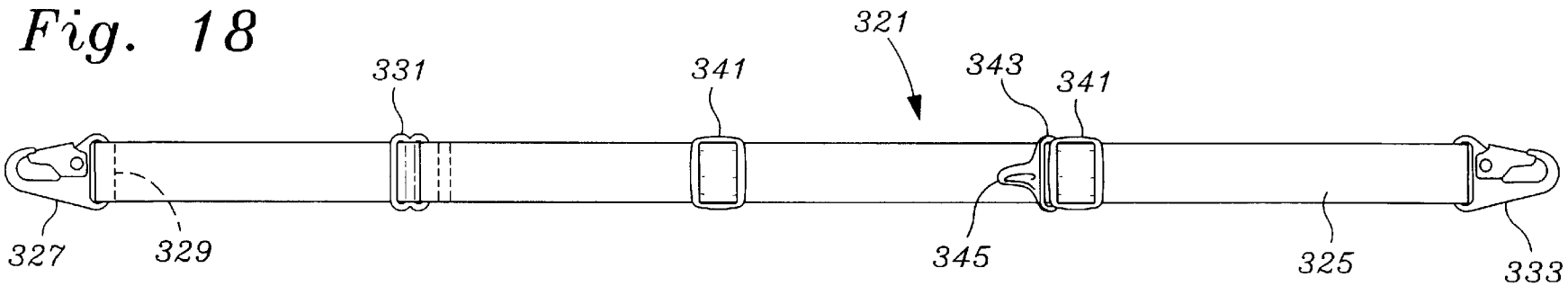
FIG. 18 is a sling strap utilizable with the second embodiment of the sling system of FIG. 17.

Referring to FIG. 18, a plan view of the sling strap 321 illustrates a length of webbing 325 having a quick connector 327 at a first end thereof and secured by a stitch 329. A length adjusting buckle 331 enables the sling strap 321 to have a significantly long range of adjustment. At a second end of the sling strap 321 a quick connector 333 is engaged by the length of webbing looping through the quick connector and back across the length of the sling strap 321 and ending at adjusting buckle 331. The extent of the sling strap between adjusting buckle 331 and quick connector 333 may be doubled. Further, a set of sliding limit buckles 341 can be utilized on either side of connector ring 319 to limit the extent of movement of a ring portion 343 and connector ring portion 345. This enables the wearer 31 to set limits on the movement of the rifle 33 in the forward and rearward direction. The adjustment of the strapping lengths of the strap sets 307, 309 and 311 can determine the ease of lateral motion of the strap set 311, as well as the height at which the rifle 33 will be supported. Adjustment of the length of the sling strap 321 determines the level and degree of arc which the rifle 33 will achieve as it is displaced forwardly and rearwardly, as well as the as well as the height at which the rifle 33 will be supported. Adjustment of the sliding limit buckles 341 will determine the degree of forward and rearward motion at slight angular pivot. All of the above adjustments give a wide range of adjustability to enable the sling system 301 to have maximum comfort for a wide variety of wearers 31, and in a wide variety of circumstances.

Figure 19:
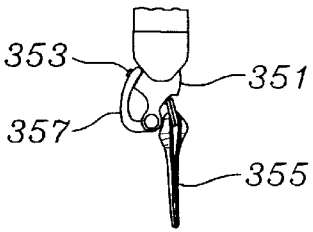
FIG. 19 is an alternative embodiment of a connector utilizable with all of the embodiments of the sling system of the present invention.

Referring to FIG. 19 an alternative to the quick connector 315 is seen as a spring pull release connector 351. A connecting pin 353 is operated by a handle 355 to release a pivoting curved member 357. The spring pull release connector 351 provides a positive lock on the connection with any structure.

Figure 20:
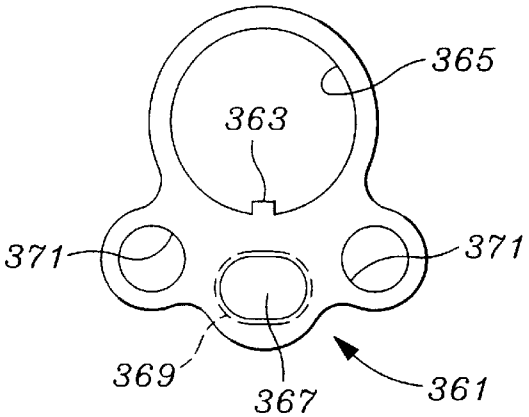
FIG. 20 is a view of a ring fitting for the AR-15 or M-16 collapsible stock rifle.

Referring to FIG. 20, a ring fitting 361 utilizable with an AR-15 rifle is seen. The ring fitting 361 is both left and right handed and typically flatter than the ring fitting 131. A projection 363 within a main aperture 365 registers the ring fitting 361. A projection 367 on one side lies opposite a depression 369 on the opposite side (shown in phantom) to further register the ring fitting 361. Connection apertures 371 extend beyond the stock of the AR-15 and provide a comparable degree of stability and support of the rifle in the quick fire or aiming position as has been seen for rifle 33.

While the present invention has been described in terms of a sling system for lending support to a rifle, for converting between a close body position and an aiming position, and for providing highly adjustable rifle support for use with other equipment such as back pack or load bearing equipments, one skilled in the art will realize that the structure and techniques of the present invention can be applied to many similar appliances. The present invention may be applied in any situation where strapping support and position conversion over a specified operating condition, and high adjustability is desired.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art. contribution to the art.

What is claimed:

1. A sling system comprising:

a chest center connector set having a first strap set for attachment to one shoulder strap of a backpack, a second strap set for attachment to another shoulder strap of a backpack, and a third attachable support;

a weapon sling having a first end attached nearer a first end of a weapon and a second end attached nearer a second end of said weapon than said first end; and a connector ring having a first opening surrounding said weapon sling and translatable at least partially along said weapon sling and having a structure for engagement with said third attachable support to enable said weapon to be supported from said chest center connector and along said weapon sling.

2. The sling system as recited in claim 1, and wherein said weapon sling includes a stop to prevent movement of said connector ring along said weapon sling in at least one direction.

3. A sling system comprising:

a chest center connector set having a first strap set for attachment to a first support near a first shoulder of a user, a second strap set for attachment to a second support near a second shoulder of a user, and a third attachable support;

a weapon sling having a first end attachable nearer a first end of a weapon and a second end attachable nearer a second end of said weapon than said first end of said weapon; and a connector ring having a first opening surrounding said weapon sling and translatable at least partially along said weapon sling and having a structure for engagement with said third attachable support to enable said weapon to be supported from said chest center connector and from at least one point along said weapon sling.

4. The sling system as recited in claim 2 and further comprising a rear ring fitting for said weapon comprising a body having a main aperture for attachment over a receiver extension tube, a depression radially spaced from said main aperture for preventing rotation of said body with respect to said receiver extension tube and for transmitting registration of a stock with respect to said receiver extension tube and at least one attachment ring radially spaced from said main aperture for facilitating support of said weapon by attachment of said second end of said weapon sling.

5. The sling system as recited in claim 2 and further comprising a sling system forward ring fitting for a weapon comprising a body having a pair of front extension fork members for engaging surfaces on said weapon, a rear bore extending through said body for alignment with attachment apertures of said weapon, and including a threaded bore between said front extension fork members and said rear bore; and a threaded member engaging said threaded aperture for bearing upon a structure of said weapon to stabilize said sling system forward ring fitting for facilitating support of said weapon by attachment of said second end of said weapon sling.

6. The sling system as recited in claim 4 wherein said ring fitting includes at least one ring opening having an axis generally parallel to an axis of said threaded member.

7. The sling system as recited in claim 2 wherein said chest center connector is a central ring and wherein said first strap set, said second strap set and said third attachable support are radially positioned about said central ring.

8. The sling system as recited in claim 2 wherein said first and second strap sets have first ends attached to said chest center connector and and second ends wherein said second end of said first strap set includes a quick connector to facilitate attachment to said first support and wherein said second end of said second strap set includes a quick connector to facilitate attachment to said second support.

9. The sling system as recited in claim 2 wherein said first and second strap sets have first ends attached to said chest center connector and second ends and wherein a length of each of said first and second strap sets, between said first and second ends of said first and second strap sets are adjustable.

10. The sling system as recited in claim 3 and wherein said third attachable support is a third strap set.

11. The sling system as recited in claim 3 and wherein said weapon sling first and second ends have quick connectors for attachment nearer said first end of said weapon and nearer said second end of said weapon, respectively.

12. The sling system as recited in claim 2 and wherein said weapon sling has an adjustable length.

13. The sling system as recited in claim 11, and wherein said weapon sling includes at least one stop to limit movement of said connector ring along said weapon sling.

* * * * *